United States Patent [19]

Colling et al.

[11] 4,052,967

[45] Oct. 11, 1977

[54] DIGITAL ELECTRONIC IGNITION SPARK TIMING SYSTEM

[75] Inventors: Ronald L. Colling, Millington; Myron U. Trenne, Utica; Timothy R. Schlax, Rochester, all of Mich.

[73] Assignee: General Motors Corporation, Detroit, Mich.

[21] Appl. No.: 699,506

[22] Filed: June 24, 1976

[51] Int. Cl.[2] ..... F02P 5/04

[52] U.S. Cl. ..... 123/117 D; 123/148 E

[58] Field of Search ..... 123/117 D, 117 R, 146.5 A, 123/148 E; 235/150.2, 150.1

[56] References Cited

U.S. PATENT DOCUMENTS

| | | | |
|---|---|---|---|
| 3,738,339 | 6/1973 | Huntzinger et al. | 123/117 D |
| 3,749,073 | 7/1973 | Asplund | 123/117 R |
| 3,752,139 | 8/1973 | Asplund | 123/117 R |
| 3,835,819 | 9/1974 | Anderson, Jr. | 123/117 R |
| 3,853,103 | 12/1974 | Wahl et al. | 123/117 D |
| 3,871,342 | 3/1975 | Fujinami et al. | 123/117 R |
| 3,927,648 | 12/1975 | Kawai et al. | 123/117 D |
| 3,976,043 | 8/1976 | Canup et al. | 123/117 D |
| 4,009,699 | 3/1977 | Hetzler et al. | 123/117 D |

*Primary Examiner*—Carroll B. Dority, Jr.
*Assistant Examiner*—Andrew M. Dolinar
*Attorney, Agent, or Firm*—Richard G. Stahr

[57] ABSTRACT

The output signal pulses of a constant frequency oscillator are counted between successive timing signals, each of which corresponds to a cylinder of an associated internal combustion engine. The total number of pulses counted during each count period is stored and employed to derive an engine speed advance binary code representation of the number of pulse counts corresponding to the predetermined number of degrees ignition spark engine speed advance for the speed at which the engine is operating. Vacuum advance binary code representation of the number of pulse counts corresponding to the predetermined number of degrees ignition spark vacuum advance is also produced and added to the engine speed advance binary code representation. The difference between the sum of the engine speed and vacuum advance binary code representations and the stored total number of pulses counted during the previous count period and the running total of pulses being counted during the present count period are applied to a comparator circuit which produces an output ignition initiating signal upon the detection of an equality. The oscillator circuit output signal pulses are also counted in another counter circuit between successive ignition initiating signals. The total number of pulses counted between successive ignition initiating signals is employed to derive a dwell initiating signal.

7 Claims, 5 Drawing Figures

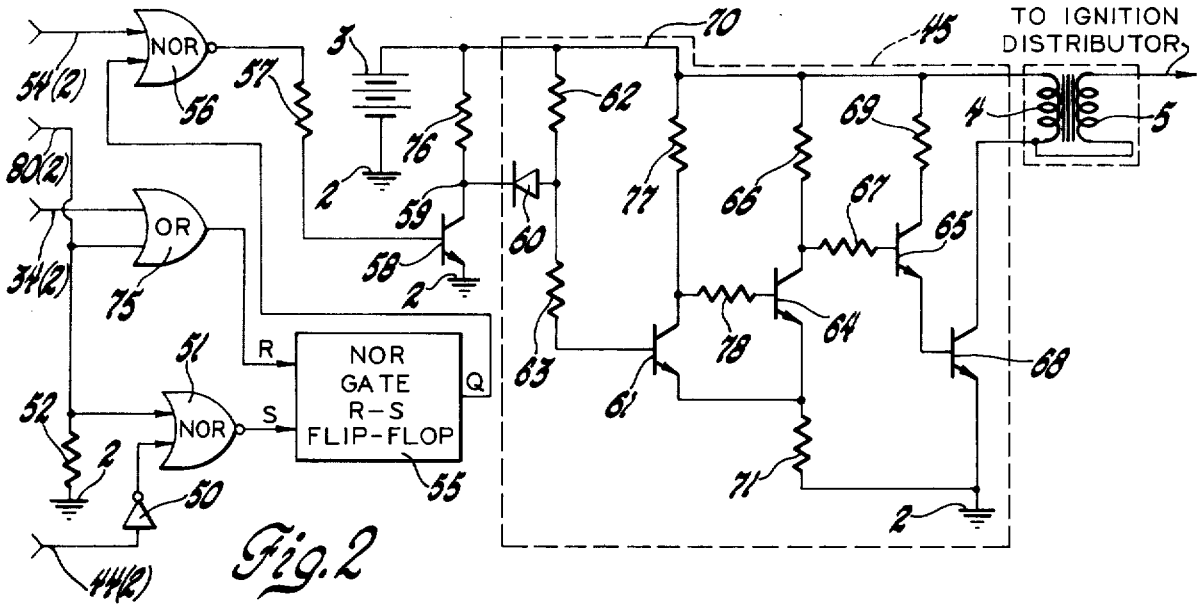
Fig. 2
| NOR GATE TRUTH TABLE | | |
|---|---|---|
| A | B | Q |
| 0 | 0 | 1 |
| 1 | 0 | 0 |
| 0 | 1 | 0 |
| 1 | 1 | 0 |
Fig. 3
| NOR GATE R-S FLIP-FLOP TRUTH TABLE | | | |
|---|---|---|---|
| R | S | Q | $\bar{Q}$ |
| 0 | 0 | Q | $\bar{Q}$ |
| 1 | 0 | 0 | 1 |
| 0 | 1 | 1 | 0 |
Fig. 4
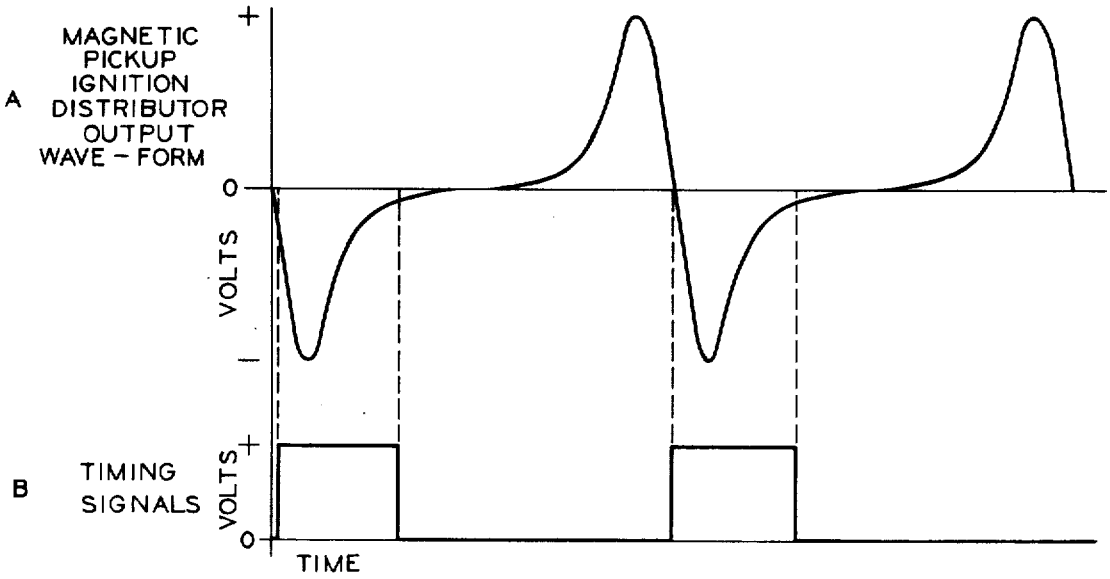
Fig. 5

DIGITAL ELECTRONIC IGNITION SPARK TIMING SYSTEM

The subject invention is directed to a digital electronic ignition spark timing system and, more specifically, to a digital electronic ignition spark timing system which provides both engine ignition spark timing and ignition dwell.

In the prior art, internal combustion engine ignition timing is adjusted in response to engine speed and intake manifold vacuum. Usually, centrifugal weights rotated by the distributor shaft mechanically produce ignition spark advance in response to engine speed and a vacuum motor exposed to engine intake manifold vacuum mechanically provides ignition spark vacuum advance in response to changes of engine vacuum. It has been found that this mechanical ignition spark timing arrangement is quite inaccurate because of the mechanical linkages involved and that the timing curve varies from engine to engine because of manufacturing tolerance errors in the parts.

Recently, digital electronic ignition spark timing has been under development, however, these systems rely upon toothed disks rotated in timed relationship with the engine and an associated magnetic pickup unit to provide a series of signal pulses, each of which corresponds to a specific engine crankshaft position in degrees. The principal disadvantage of these prior art digital electronic ignition spark timing systems is the difficulty in producing accurate toothed disks in mass production and the magnetic pickup assembly is subject to mechanical misalignment. Furthermore, disk wobble, eccentricity, and stray magentic fields may introduce spurious signal pulses to the system which alter the desired ignition spark timing.

A digital electronic ignition spark timing system which is not dependent upon signal pulses produced by a magnetic pickup arrangement is, therefore, desirable.

It is, therefore, an object of this invention to provide an improved digital electronic ignition spark timing system.

It is another object of this invention to provide an improved digital electronic ignition spark timing system which provides ignition spark timing in response to the number of constant frequency oscillator output signal pulses counted between successive engine piston position indicating signals.

It is an additional object of this invention to provide an improved digital electronic ignition spark timing system which provides both ignition initiating signals and ignition dwell signals.

It is a further object of this invention to provide an improved digital electronic ignition spark timing system which is arranged to employ timing signals produced for each cylinder of an associated engine at a selected engine crankshaft position in degrees relative to piston top dead center to provide for the establishing and interruption of the ignition coil primary winding energizing circuit in response to the leading and trailing edges of the timing signals, respectively, while the engine is in the crank mode.

In accordance with this invention, a digital electronic ignition spark timing system is provided wherein the number of constant frequency oscillator signal pulses counted between successive engine piston position indicating signals is employed to produce ignition initiating signals and the number of oscillator pulses counted between successive ignition initiating signals is employed to produce ignition dwell signals.

For a better understanding of the present invention, together with additional objects, advantages and features thereof, reference is made to the following description and accompanying drawings in which:

FIG. 1 sets forth the digital electronic ignition spark timing system of this invention in block form;

FIG. 2 is a representation partially in schematic and partially in block form of circuitry responsive to the output signals of the circuit of FIG. 1 for completing and interrupting the engine ignition system ignition coil primary winding energizing circuit;

FIG. 3 is a truth table for a conventional NOR gate;

FIG. 4 is a truth table for a conventional NOR gate RS flip-flop circuit; and

FIG. 5 is a set of curves useful in understanding the system of FIG. 1.

Figure 1:
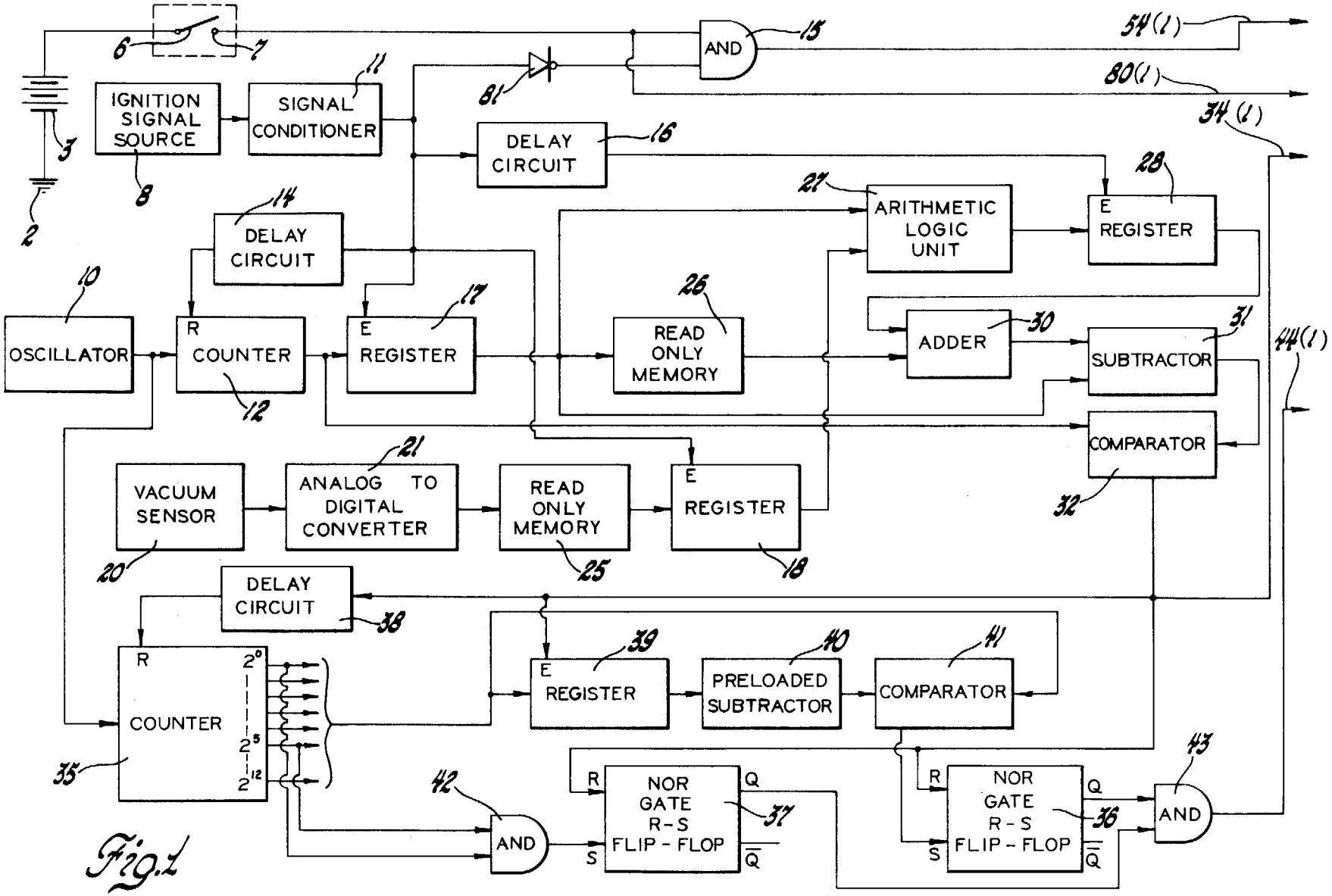

As point of reference or ground potential is the same point electrically throughout the system, it has been illustrated in FIGS. 1 and 2 of the drawing by the accepted schematic symbol and reference by the numeral 2.

Operating potential may be supplied by a conventional automative type storage battery, referenced by the numeral 3 in both FIGS. 1 and 2, or any other convenient direct current potential source of a rating compatible with the circuit elements employed. In the interest of reducing drawing complexity, the output potential of battery 3 has not been indicated as applied to the block diagrams of these circuits. It is to be specifically understood, however, that operating potential for all of these modules is supplied by battery 3.

The digital electronic ignition spark timing system of this invention is applicable to an associated internal combustion engine for controlling the energizing circit of the engine ignition system ignition coil primary winding. In the interest of reducing drawing complexity, the engine has not been illustrated in the drawing, however, in FIG. 2, the engine ignition system ignition coil primary winding 4 and secondary winding 5 is set forth in schematic form.

The movable contact 6 and stationary contact 7 of FIG. 1 represent the normally open cranking motor energizing circuit electrical contacts of a conventional automotive type ignition switch. As is well-known in the automotive art, the ignition switch cranking motor energizing circuit electrical contacts are operated to the electrical circuit closed condition only while the associated engine is in the "crank" mode. The significance of this contact pair will be brought out later in this specification.

An ignition signal source 8 of the type which produces output signals in timed relationship with the associated engine is provided for producing ignition reference signals to which the ignition timing is referenced. Ignition signal source 8 may be any of the many well-known devices employed in the automotive art to produce ignition signals in timed relationship with an associated engine or any other convenient arrangement. In the preferred embodiment, a magnetic pickup type ignition distributor which produces an output alternating current wave form as illustrated by curve A of FIG. 5 is employed for the purpose of providing these ignition reference signals. One example of a magnetic pickup type ignition distributor suitable for this application is disclosed and described in U.S. Pat. No. 3,254,247, Falge, which issued May 31, 1966, and is assigned to the same assignee as is this invention. Referring to curve A of FIG. 5, each positive to negative polarity zero crossover point of the distributor output signal wave form corresponds to a cylinder of the associated internal combustion engine. In an 8-cylinder engine, for example, a positive to negative zero crossover point occurs every 90 engine crankshaft degrees.

A series of electrical signal pulses of a substantially constant preselected frequency is produced by an oscillator circuit 10. In the preferred embodiment, the preselected constant frequency of oscillator circuit 10 is 65.536 kilohertz. Any conventional substantially constant frequency oscillator circuit may be employed with this application.

To provide a timing signal for each cylinder of the associated internal combustion engine at a selected engine crankshaft position in degrees relative to piston top dead center, the negative polarity excursions of the distributor output signal wave form, curve A of FIG. 5, are converted to square wave form pulses by a signal conditioner circuit 11. Signal conditioner circuit 11 may be a conventional astable multivibrator circuit of a type well-known in the art or it may be a conventional Schmitt trigger type circuit also wellknown in the art, or any other wave squaring circuit. In the preferred embodiment, signal conditioner circuit 11 is a conventional Schmitt trigger circuit having respective different trigger signal level settings for Set and Reset conditions. The Schmitt trigger circuit employed is calibrated to trigger to the Set condition in which a logic 1 signal is present upon the output terminal thereof as near to each positive to negative zero crossover point of the ignition reference signals as is possible and to trigger to the Reset condition in which a logic zero signal is present upon the output terminal thereof at a point at which each negative polarity excursion of the ignition reference signals approach zero or ground potential, as illustrated by curve B of FIG. 5. The time duration between the leading edges of successive timing signals is hereinafter referred to as an engine timing count period. As the remainder of the digital electronic ignition spark timing system of this invention is clocked by the leading edge of each of these timing signals, it is important that each leading edge be precisely located relative to the top dead center position of the piston of the cylinder to which it corresponds. In the preferred embodiment, the ignition distributor was mechanically adjusted in a manner well-known in the art to the position at which the leading edge of each timing signal occurred at eight engine crankshaft degrees before piston top dead center for the purpose of providing an initial ignition spark advance. The leading and trailing edges of the timing signals are employed, in a manner to be later explained, for the purpose of completing and interrupting, respectively, the energizing circuit of the ignition coil primary winding 4 while the associated engine is in the "crank" mode. Therefore, the pulse width of each is selected to be of sufficient duration to permit a primary winding energizing current buildup which, upon interruption, will result in a potential induced in secondary winding 5 of a sufficient potential magnitude to produce an ignition spark.

Referring to FIG. 1, the output electrical signal pulses of oscillator 10 are applied to the input terminals of a counter circuit 12 which may be any of the several commercially available binary counter packages of the type which counts electrical signal pulses and produces a running total output binary coded number of electrical signal pulses counted. In the preferred embodiment, a 12-stage binary counter circuit which provides a total of 2,048 counts and produces a running total output binary coded number of signal pulses counted is employed.

For purposes of the following description of the digital electronic ignition spark timing system of this invention set forth in FIG. 1, it will be assumed that the associated internal combustion engine is in the "Run" mode.

Initially in this description, only the reset of counter circuit 12 and the subsequent count of oscillator 10 output electrical signal pulses during an engine timing count period, hereinafter referred to as the first engine timing count period, will be considered. The remainder of the circuitry of FIG. 1 will then be explained with regard to this first engine timing count period.

Upon the occurrence of the leading edge of a timing signal, the first engine timing count period is initiated. This leading edge of this first considered timing signal is delayed for a period of a half to one microsecond by a conventional electrical signal delay circuit 14. At the conclusion of this delay period, the output signal of delay circuit 14 resets counter circuit 12, which counts the oscillator 10 output electrical signal pulses during each engine timing count period, to zero. After being reset to zero, counter circuit 12 begins counting with a count of one the oscillator 10 output electrical signal pulses, continues to count these electrical signal pulses during this first engine timing count period and produces a running total output binary coded number of the electrical signal pulses counted.

Concurrently during the first engine timing count period, the associated internal combustion engine intake manifold vacuum is monitored by a commercially available vacuum sensor 20 of the type which produces an output analog signal of a potential magnitude directly proportional to engine intake manifold vacuum. This analog signal is applied to the input terminal of a conventional commercially available analog to digital converter circuit 21 which converts the analog output signal of vacuum sensor 20 to digital signal representations of engine intake manifold vacuum which are applied to the input terminals of a conventional commercially available read only memory circuit 25. The ignition spark vacuum advance for the associated internal combustion engine is empirically determined for various values of engine intake manifold vacuum. These predetermined ignition spark vacuum advance values are stored in read only memory circuit 25 which is preprogrammed to produce, in response to the digital signal representation of intake manifold vacuum, output ignition spark vacuum advance binary code representations of the predetermined number of engine crankshaft degrees ignition spark vacuum advance corresponding to the value of intake manifold vacuum as indicated by the digital signal representation output of analog to digital converter circuit 21.

Upon the occurrence of the leading edge of the next second timing signal which initiates the second engine timing count period, this leading edge of this second timing signal is applied to the input terminal of a conventional AND gate 15, to the input terminals of respective conventional electrical signal delay circuits 14 and 16 and to the "enable" input terminal of each of conventional register circuits 17 and 18. Register circuits 17 and 18 may be commercially available binary register circuit packages of the type which accept binary code input signals applied to the input terminals thereof upon the application of an enabling signal to the enabling input terminal thereof and maintains or stores the accepted binary code input signals until another binary code input signal group is accepted thereby.

Register circuit 17 accepts at the initiation of each engine timing count period, upon being enabled by the leading edge of each successive timing signal, the counter circuit 12 output binary coded total number of oscillator 10 output electrical signal pulses counted during the previous engine timing count period and stores this binary coded number until the initiation of the next engine timing count period. Therefore, register circuit 17, upon being enabled by the leading edge of this second timing signal, accepts the counter circuit 12 output binary coded total number of oscillator 10 output electrical signal pulses counted during the previous first engine timing count period and stores this binary coded number during this current second engine timing count period. Register circuit 18 accepts at the initiation of each engine timing count period, upon being enabled by the leading edge of each successive timing signal, the read only memory circuit 25 output ignition spark vacuum advance binary code representation and stores this ignition spark vacuum advance binary code representation until the initiation of the next engine timing count period. Therefore, register circuit 18, upon being enabled by the leading edge of this second timing signal, accepts the read only memory circuit 25 output ignition spark vacuum advance binary code representation and stores this binary code representation during this current second engine timing count period.

At the conclusion of the delay period introduced by delay circuit 14, counter circuit 12 is reset to zero and begins counting with a count of one the oscillator 10 output electrical signal pulses during this second engine timing count period as previously explained.

The counter circuit 12 output binary coded total number of oscillator 10 electrical signal pulses counted during the first engine timing count period stored in register 17 is applied to and maintained upon the input circuit terminals of a conventional commercially available read only memory circuit 26. The ignition spark engine speed advance is empirically determined for a plurality of various engine speeds of the associated internal combustion engine. These predetermined ignition spark engine speed advance values are stored in read only memory circuit 26 which is preprogrammed to produce, in response to the counter circuit 12 output binary coded total number of oscillator 10 output electrical signal pulses stored in register circuit 17, output binary code representations of the fractional portion of the binary coded number stored in register circuit 17 that the predetermined number of crankshaft degrees ignition spark engine speed advance corresponding to the engine speed at which the stored binary coded number of electrical signal pulses may be counted during one engine timing count period is of the number of engine crankshaft degrees between successive timing signals.

The binary coded total number of oscillator 10 output electrical signal pulses counted during the previous first engine timing count period, stored in register circuit 17, and the read only memory circuit 25 output engine ignition spark vacuum advance binary code representations, stored in register circuit 18, are impressed upon an arithmetic logic circuit 27. Arithmetic logic unit 27 is a conventional circuit device well-known in the art which is preprogrammed to produce as an output the binary code representation of the quotient of the product of the engine ignition spark vacuum advance binary code representation stored in register circuit 18 multiplied by the binary code total number of oscillator 10 output signal pulses counted during the previous first engine timing count period stored in register circuit 17 divided by the number of engine crankshaft degrees between successive timing signals.

As has been previously brought out, the leading edge of the second timing signal is applied to delay circuit 16 which introduces a delay period of a sufficient duration to permit arithmetic logic unit 27 to complete the required mathematical calculations hereinabove described, for example, 2 to 2 ½ microseconds. At the conclusion of the delay period introduced by delay circuit 16, the output signal thereof is applied to the enable input terminal of a conventional commercially available register circuit 28 of the same type as are register circuits 17 and 18. Register circuits 28, upon being enabled by the output signal of delay circuit 16, accepts the output binary code representation of arithmetic logic unit 27 and stores this binary code representation until next enabled during the next third engine timing count period. The arithmetic logic unit 27 output binary code representation stored in register circuit 28 is added to the read only memory circuit 26 output binary code representation in a conventional binary adder circuit 30 of a type well-known in the art which produces an output binary code representation of the sum of the arithmetic logic unit 27 output binary code representation and the read only memory circuit 26 output binary code representation. The adder circuit 30 output binary code representation is subtracted from the register circuit 17 output binary code representation, the binary coded total number of oscillator 10 output electrical signal pulses counted during the previous first engine timing count period, in a conventional binary subtractor circuit 31 of a type well-known in the art which produces an output binary code representation of the difference between the adder circuit 30 output binary code representation and the register circuit 17 output binary coded number. The sequence of events hereinabove described as taking place since the initiation of this second engine timing count period including the production of the subtractor circuit 31 output binary code representation, takes place in the period of time between oscillator 10 output electrical signal pulses. With an oscillator 10 operating frequency of 65.536 kilohertz as employed in the preferred embodiment, the output electrical signal pulse rate is one pulse every 15.2 microseconds. This time between oscillator 10 output electrical signal pulses is of an ample duration to complete the series of events hereinabove described. The subtractor circuit 31 output binary code representation and the counter circuit 12 running total output binary coded number of oscillator output electrical signal pulse being counted during this second engine timing count period are applied to respective input terminal groups of a conventional commercially available comparator circuit 32. Comparator circuit 32 is of the type which produces a logic 1 output ignition initiating signal when one of the running total output binary coded numbers of counter circuit 12 is equal to the binary subtractor circuit 31 output binary code representation. In a manner to be later explained, a conventional electronic ignition system 45 of FIG. 2 operates to abruptly interrupt the engine ignition system ignition coil primary winding 4 energizing circuit in response to the occurrence of each ignition initiating signalproduced by comparator circuit 32.

To clarify the operation of the digital electronic ignition spark timing system of this invention, the hereinabove set forth sequence of events will now be described with regard to actual numerical values. For purposes of this description, it is assumed that the ignition spark timing system of this invention is employed with an eight-cylinder internal combustion engine, that the oscillator circuit 10 operating frequency is 65.536 kilohertz, that the engine is operating at 2190 RPM, that the predetermined ignition spark engine speed advance is eighteen engine crankshaft degrees at 2190 RPM and the predetermined ignition spark vacuum advance is eight crankshaft degrees for a total of twenty-six engine crankshaft degrees advance. With an eight-cylinder engine, a timing signal is produced every ninety engine crankshaft degrees. Therefore, at 2185 RPM, counter circuit 12 may count 450 oscillator 10 output electrical signal pulses during an engine timing count period which is 0.2 engine crankshaft degrees per count. The fractional portion of the number of oscillator 10 output electrical signal pulses counted during the previous engine timing count period (450) that the predetermined number of engine crankshaft degrees ignition spark engine speed advance (18° ) corresponding to the engine speed (2190 RPM) at which the stored binary coded number (450) of electrical signal pulses may be counted during one engine timing count period is of the number of engine crankshaft degrees (90) between successive timing signals is ninety oscillator 10 output electrical signal pulse counts (18°/90° × 450) or 0.2 engine crankshaft degrees per count. Read only memory circuit 26, therefore, it preprogrammed to produce an output binary code representation of ninety oscillator 10 output electrical pulses in response to an input binary coded number of 450 oscillator 10 output electrical signal pulses. Read only memory circuit 25 is preprogrammed to produce an output ignition spark vacuum advance binary code representation of the predetermined number (8) of engine crankshaft degrees ignition spark vacuum advance. Arithmetic logic unit 27 multiplies the read only memory circuit 25 output binary code representation of eight engine crankshaft degrees by the binary coded number (450) stored in register circuit 17 and divides this product by the number of engine crankshaft degrees (90) between timing signals. Arithmetic logic unit 27, therefore, produces an output binary code representation of the number (40) of oscillator 10 output electrical pulse counts corresponding to eight engine crankshaft degrees ignition spark advance (8° × 450)/90). The arithmetic logic unit 27 output binary code representation (40) of oscillator 10 output electrical signal pulse counts for eight engine crankshaft degrees ignition spark vacuum advance and the read only memory circuit 26 output binary code representation (90) of oscillator 10 output electrical signal pulse counts for eighteen engine crankshaft degrees ignition spark engine speed advance are added in binary adder circuit 30. The binary adder circuit 30 output binary code representation of this sum (130) is subtracted from the binary coded number of oscillator 10 output signal pulses (450) counted by counter circuit 12 during the previous engine timing count period, stored in register circuit 17, in binary subtractor circuit 31. The binary subtractor circuit 31 output binary code representation of this difference (320) and the counter circuit 12 running total output binary coded number of oscillator 10 output electrical signal pulses being counted during this second engine timing count period are applied to respective input circuit groups of comparator circuit 32. Comparator circuit 32 produces an output logic 1 ignition initiating signal when the counter circuit 12 running total output binary coded number of oscillator 10 output electrical signal pulses counted reaches 320. As each oscillator 10 output electrical signal pulse count is equal to 0.2 engine crankshaft position degrees, the logic 1 ignition initiating signal is produced 26 engine crankshaft degrees in advance of the next timing signal (450 − 320 × 0.2).

The digital electronic ignition spark timing system of this invention also includes circuitry which provides ignition dwell, the period of time during which the ignition coil primary winding 4 is energized by battery 3. This circuitry produces a dwell initiating signal during each engine timing count period prior to the time that the ignition initiating signal is produced during the same engine timing count period. In a manner to be later explained, the conventional electronic ignition system 45 of FIG. 2 operates to complete the engine ignition system ignition coil primary winding 4 energizing circuit in response to the occurrence of each dwell initating signal during each engine timing count period. At engine speeds up to 3750 RPM, the dwell initiating signal is produced during each engine timing count period at the number of oscillator 10 output electrical signal pulse counts before the next ignition initiating signal that may be counted during the predetermined dwell period. Therefore, a binary counter circuit 35, FIG. 1, is provided for counting oscillator 10 output electrical signal pulses during each ignition dwell count period between successive logic 1 ignition initiating signals and producing a running total output binary coded number of electrical signal pulses counted. Counter circuit 35 may be any of the several commercially available binary counter packages of the type which counts electrical signals pulses and produces a running total output binary coded number of electrical signal pulses counted. In the preferred embodiment, a 12-stage binary counter circuit which provides a total of 2048 counts and produces a running total output binary coded number of signal pulses counted is employed.

The logic 1 ignition initiating signals produced by comparator circuit 32 appear across leads 34(1) of FIG. 1 and 34(2) of FIG. 2 and point of reference or ground potential 2. These logic 1 ignition initiating signals are applied to the "R" Reset input terminal of each of NOR gate RS flip-flop circuits 36 and 37, to the input terminal of a conventional electrical signal delay circuit 38 and to the enable input terminal of register circuit 39 which may be a conventional binary register circuit of the same type as are register circuits 17, 18 and 28. The NOR gate RS flip-flop circuit is a well-known logic circuit element which produces a logic 0 signal upon the "Q" output terminal upon the application of a logic 1 signal to the "R" Reset input terminal and a logic 1 signal upon the "Q" output terminal upon the application of a logic 1 signal to the "S" Set input terminal thereof, as indicated by the truth table of FIG. 4.

The logic 1 ignition initiating signal produced during the engine timing count period next preceding the previous first engine timing count period initiated the previous first ignition dwell count period. This signal was also delayed by delay circuit 38 for a period of one-half to one microsecond. At the conclusion of this delay period, the output signal of delay circuit 38 reset counter circuit 35 to zero. After being reset to zero, counter circuit 35 began counting with a count of one the oscillator 10 output electrical signal pulses during the previous first ignition dwell count period, continued to count these electrical signal pulses until the occurrence of the next ignition initiating signal which was produced during the previous first engine timing count period and which initiates this second ignition dwell count period and produced a running total output binary coded total number of the electrical signal pulses counted during the previous first ignition dwell count period. Upon being enabled by the ignition initiating signal produced during the previous first engine timing count period which initiates this second ignition dwell count period, register circuit 39 accepts the counter circuit 35 output binary coded total number of oscillator 10 output signal pulses counted during the previous first ignition dwell count period and stores this binary coded number during this second ignition dwell count period until the occurrence of the next ignition initiating signal during this second engine timing count period. The output binary coded total number of oscillator 10 output electrical signal pulses counted during the previous first ignition dwell count period stored in register circuit 39 is applied to the input terminals of a conventional binary subtractor circuit 40. Binary subtractor circuit 40 produces an output binary code representation of the difference between the binary coded total number of oscillator 10 output electrical signal pulses stored in register circuit 39 and a preloaded predetermined constant number as determined by the predetermined ignition dwell period. In the preferred embodiment, the ignition dwell period was selected to be four milliseconds. As the operating frequency of oscillator 10 in the preferred embodiment is 65.536 kilohertz, the repetition rate of the output electrical signal pulses is 15.2 microseconds. Therefore, binary counter circuit 35 counts 262 oscillator 10 output electrical signal pulses in four milliseconds. The predetermined constant number preloaded into binary subtractor circuit 40, therefore, is the binary code representation of 262. The binary subtractor circuit 40 output binary code representation and the running total output binary coded number of oscillator 10 output electrical signal pulses being counted during this second ignition dwell count period are applied to respective input terminal groups of a conventional comparator circuit 41. Comparator circuit 41 may be a conventional commercially available binary comparator circuit of the same type as is comparator circuit 32 which produces an output logic 1 signal when one of the counter circuit 35 running total output binary coded numbers is equal to the binary subtractor circuit 40 output binary code representation. Upon the occurrence of an equality, comparator circuit 41 produces an output logic 1 signal which is applied to the "S" Set input terminal of NOR gate RS flip-flop circuit 36 to trigger this device to the Set condition in which a logic 1 dwell signal initiating signal enabling signal is present upon the "Q" output terminal thereof. At engine speeds greater than 3750 RPM, comparator circuit 41 detects an equality between the running total output binary coded number of oscillator 10 output electrical signal pulses being counted and the binary subtractor circuit 40 output binary code representation with the next oscillator 10 output electrical signal pulse counted. Therefore, at the higher engine speeds, there may be insufficient time to permit the previously initiated spark to complete firing. In the preferred embodiment, one-half millisecond is allowed for the previously instituted ignition spark to complete firing. At a repetition rate of 15.2 microseconds, counter circuit 35 counts thirty-three oscillator 10 output electrical signal pulses in one-half millisecond. Consequently, the binary coded number 33 is applied to the input terminals of a conventional two input AND gate 42 which produces a logic 1 output signal when counter circuit 35 has counted thirty-three oscillator 10 output signal pulses. This logic 1 AND gate 42 output signal is applied to the "S" Set input terminal of NOR gate RS flip-flop circuit 37 to trigger this device to the Set condition in which a logic 1 dwell signal initiating signal enabling signal is present upon the "Q" output terminal thereof. With the presence of the dwell initiating signal enabling signal produced by NOR gate RS flip-flop circuit 36 and the dwell initiating signal enabling signal produced by NOR gate RS flip-flop circuit 37 present upon both input terminals of two input AND gate 43, AND gate 43 produces an output logic 1 dwell initiating signal which is applied through leads 44(1) of FIG. 1 and 44(2) of FIG. 2 to the input terminal of a conventional signal inverter circuit 50 of a type well-known in the art. Inverter circuit 50 inverts this logic 1 ignition dwell initiating signal to a logic 0 signal upon the output terminal thereof which is applied to one of the input terminals of conventional two input NOR gate 51. As the engine is in the "Run" mode, electrical contacts 6 and 7 of FIG. 1 are open, therefore, a logic 0 signal is also present upon the other input terminal of NOR gate 51 connected to point of reference or ground potential 2 through resistor 52, NOR gate 51, therefore, produces a logic 1 output signal. This logic 1 output signal is applied to the "S" Set input terminal of NOR gate RS flip-flop circuit 55 to trigger this device to the Set condition in which a logic 1 signal is present upon the "Q" output terminal thereof. This logic 1 output signal is applied to one of the input terminals of two input NOR gate 56. As the associated engine is in the "Run" mode, movable contact 6 of FIG. 1 is out of electrical engagement with associated stationary contact 7. Consequently, a logic 0 signal is present upon the output terminal of conventional two input AND gate 15. This logic 0 signal is applied through leads 54(1) of FIG. 1 and 54(2) of FIG. 2 to the other input terminal of NOR gate 56. With the presence of a logic 0 and a logic 1 signal upon respective input terminals thereof, NOR gate 56 produces a logic 0 output signal. This logic 0 signal, applied through resistor 57 to the base electrode of NPN transistor 58, base biases NPN transistor 58 not conductive. While transistor 58 is not conductive, a logic 1 signal of a potential substantially equal to the potential of battery 3 is present upon junction 59 to reverse bias diode 60 which now has substantially the same potential applied to both the anode and cathode electrodes thereof. When diode 60 becomes reverse biased, base-emitter drive current is supplied to NPN transistor 61 through resistors 62 and 63. While base-emitter drive current is supplied to transistor 61, this device conducts through the collector-emitter electrodes thereof to divert base-emitter drive current from NPN transistor 64, consequently, transistor 64 extinguishes. While transistor 64 is not conductive, base-emitter drive current is supplied to NPN transistor 65 through resistors 66 and 67, consequently, transistor 65 conducts through the collector-emitter electrodes. While transistor 65 conducts through the collector-emitter electrodes, base-emitter drive current is supplied to NPN switching transistor 68 through resistor 69 and the collector-emitter electrodes of transistor 65. While base-emitter drive current is supplied to switching transistor 68, this device conducts through the collector-emitter electrodes to complete the ignition coil primary winding 4 energizing circuit which may be traced from the positive polarity terminal of battery 3 through lead 70, primary winding 4, the collector-emitter electrodes of switching transistor 68 and point of reference or ground potential 2 to the negative polarity terminal of battery 3. Resistor 71 provides a reverse bias upon the emitter electrode of transistor 64 when transistor 61 is triggered conductive to provide a more sharp cut-off thereof upon the conduction of transistor 61. Consequently, the engine ignition system ignition coil primary winding energizing circuit is completed four milliseconds before the occurrence of the logic 1 ignition initiating signal produced during this second engine timing count period in response to the ignition dwell initiating signal just produced.

The logic 1 ignition initiating signal produced by comparator circuit 32 is applied to one of the input terminals of a conventional two input OR gate 75, FIG. 2, through leads 34(1) of FIG. 1 and 34(2) of FIG. 2. In response to this logic 1 ignition initiating signal produced by comparator circuit 32, two input OR gate 75 produces a logic 1 output signal which is applied to the "R" Reset terminal of NOR gate RS flip-flop circuit 55. Upon the application of the logic 1 output signal of OR gate 75 to the "R" Reset input terminal of NOR gate RS flip-flop circuit 55, this device is triggered to the Reset condition in which a logic 0 signal is present upon the "Q" output terminal thereof. This logic 0 output signal is applied to one of the input terminals of a conventional two input NOR gate 56. As the associated engine is in the "Run" mode, movable contacts 6 and 7 of FIG. 1 are open. Consequently, a logic 0 signal is present upon the output terminal of conventional two input AND gate 15 which is applied through leads 54(1) of FIG. 1 and 54(2) of FIG. 2 to the other input terminal of NOR gate 56. As two input NOR gates produce a logic 1 output signal with the application of a logic 0 to both of the input terminals thereof, as indicated by the two input NOR gate truth table of FIG. 3, NOR gate 56 produces a logic 1 output signal which is applied through current limiting resistor 57 to the base electrode of an NPN transistor 58 in the proper polarity relationship to produce base-emitter drive current through an NPN transistor. As the collector-emitter electrodes of NPN transistor 58 are connected across battery 3 through collector resistor 76 in the proper polarity relationship for forward conduction through an NPN transistor, transistor 58 conducts through the collector-emitter electrodes, a condition which places junction 59 at substantially ground potential. At the moment diode 60 becomes forward biased by the substantially ground potential on junction 59, conducting transistor 58 diverts base-emitter drive current from NPN transistor 61 to extinguish this device. With NPN transistor 61 not conducting, base-emitter drive current is supplied to NPN transistor 64 through resistors 77 and 78 in the proper polarity relationship to produce base-emitter drive current through an NPN transistor, consequently, transistor 64 conducts through the collector-emitter electrodes. Conducting transistor 64 diverts base-emitter drive current from NPN transistor 65, extinguishes. When transistor 65 extinguishes, base-emitter drive current is no longer supplied to NPN switching transistor 68, consequently, switching transistor 68 extinguishes to abruptly interrupt the ignition coil primary winding 4 energizing circuit. Upon each interruption of the primary winding 4 energizing circuit, an ignition spark potential of a sufficiently high value to initiate an ignition spark across the arc gap of the engine spark plug to which it is directed is induced in secondary winding 5 by the resulting collapsing magnetic field in a manner well-known in the automotive art. This high ignition potential is directed to the next spark plug to be fired through a conventional ignition distributor, not shown, in a manner well-known in the automotive art. As the logic 0 signal is maintained upon both input terminals of two input NOR gate 56 until NOR gate RS flip-flop circuit 55 is triggered to the Set condition by a logic 1 signal applied to the "S" Set input terminal thereof, transistor 58 remains conductive through the collector-emitter electrodes thereof to maintain junction 59 at substantially ground potential and ignition coil primary winding switching transistor 68 is extinguished. This logic 1 ignition initiating signal applied to the "R" Reset input terminals of NOR gate RS flip-flop circuits 36 and 37 triggers these devices to the Reset condition in which a logic 0 signal is present upon the "Q" output terminal of each. These logic 0 signals are applied to respective input terminals of a conventional two input AND gates 43, consequently, AND gate 43 produces a logic 0 output signal which is applied through leads 44(1) of FIG. 1 and 44(2) of FIG. 2 to the input terminal of signal inverter circuit 50. This AND gate 43 logic 0 output signal is inverted by inverter circuit 50 to a logic 1 output signal which is applied to one of the input terminals of conventional two input NOR gate 51. As the engine is in the "Run" mode with movable contact 6 and stationary contact 7 of FIG. 1 operated to the electrical circuit open condition, a logic 0 signal is present upon the other input terminal of NOR gate 51 connected to point of reference or ground potential 2 through resistor 52. Consequently, NOR gate 51 produces a logic 0 signal upon the output terminal thereof which is applied to the "S" Set input terminal of NOR gate RS flip-flop circuit 55. This logic 0 signal, however, is ineffective to trigger NOR gate flip-flop circuit 55 to the Set condition, consequently, transistor 58 remains conductive to maintain switching transistor 68 not conductive until the occurrence of the next dwell initiating signal.

So long as the associated internal combustion engine remains in the "Run" mode, the digital electronic ignition spark timing system of this invention continues to operate in a manner just explained to complete the engine ignition system ignition coil primary winding energizing circuit and to interrupt this energizing circuit at the number of engine crankshaft degrees ignition spark advance as determined by engine speed and manifold vacuum during each engine timing count period.

To initiate the "Crank" mode for the associated internal combustion engine, movable contact 6 of FIG. 1 is operated into electrical circuit engagement with stationary contact 7. Upon the closure of these switch contacts, a logic 1 signal is applied to one input terminal of a conventional AND gate 15 and, through leads 80(1) of FIG. 1 and 80(2) of FIG. 2 to one of the input terminals of conventional OR gate 75. Upon the application of this logic 1 signal to one of the input terminals of OR gate 75, this device produces a logic 1 output signal which is applied to the "R" Reset terminal of NOR gate RS flip-flop circuit 55 to trigger this device to the Reset condition in which a logic 0 is present upon the "Q" output terminal thereof. This logic 0 signal is applied to one of the input terminals of NOR gate 56 to enable this device. The logic 1 leading edge of the first timing signal is inverted by inverter circuit 81 to a logic 0 signal which is applied to the other input terminal of AND gate 15, consequently, AND gate 15 produces a logic 0 output signal. This logic 0 output signal of AND gate 15 is applied through leads 54(1) of FIG. 1 and 54(2) of FIG. 2 to the other input terminal of NOR gate 56. With a logic 0 signal present upon both input terminals, NOR gate 56 produces a logic 1 output signal which is applied through resistor 57 to the base electrode of NPN transistor 58 to trigger this device conductive through the collector-emitter electrodes. While transistor 58 is conductive through the collector-emitter electrodes, a logic 0 signal is present upon junction 59. With a logic 0 signal present upon junction 59, conventional electronic ignition system 45 operates in a manner previously explained to interrupt the engine ignition coil primary winding 4 energizing circuit. With the trailing edge of this timing signal, a logic 1 signal is present upon both input terminals of AND gate 15. With a logic 1 signal present upon both input terminals thereof, AND gate 15 produces a logic 1 output signal which is applied through leads 54(1) of FIG. 1 and 54(2) of FIG. 2 to one of the input terminals of NOR gate 56. With a logic 1 and a logic 0 signal present upon respective input terminals, NOR gate 56 produces a logic 0 output signal which is applied through resistor 57 to the base electrode of transistor 58 to extinguish this device. While transistor 58 is not conductive through the collector-emitter electrodes, a logic 1 signal is present upon junction 59. With a logic 1 signal present upon junction 59, conventional electronic ignition system 45 operates in a manner previously explained to complete the ignition coil primary winding 4 energizing circuit which remains completed until the occurrence of the leading edge of the next timing signal.

From this description, it is apparent that while the associated internal combustion engine is in the "Crank" mode, the ignition coil primary winding 4 energizing circuit is interrupted and completed in response to the leading and trailing edges, respectively, of the timing signals.

While a preferred embodiment of the preferred invention has been shown and described, it will be obvious to those skilled in the art that various modifications and substitutions may be made without departing from the spirit of the invention which is to be limited only within the scope of the appended claims.

What is claimed is:

1. A digital electronic ignition spark timing system applicable to an associated internal combustion engine for producing ignition initiating signals for effecting the interruption of the engine ignition system ignition coil primary winding energizing circuit, comprising:

means for producing a series of electrical signal pulses of a substantially constant preselected frequency;

means for producing a timing signal for each cylinder of said engine at a selected engine crankshaft position in degrees relative to piston top dead center;

means for counting said electrical signal pulses during each engine timing count period between successive said timing signals and producing a running total output binary coded number of said electrical signal pulses counted;

circuit means for accepting upon the initiation of each said engine timing count period the said running total output binary coded total number of said electrical signal pulses counted during the previous said engine timing count period and for storing this binary coded number until the initiation of the next said engine timing count period;

means responsive to said stored binary coded number for producing an output first binary code representation of the fractional portion of said stored binary coded number that the predetermined number of crankshaft degrees ignition spark engine speed advance corresponding to the engine speed at which said stored binary coded number of said electrical signal pulses may be counted during one said engine timing count period is of the number of engine crankshaft degrees between successive said timing signals;

means responsive to the intake manifold vacuum of said engine for producing digital signal representations thereof, means responsive to said digital signal representations of intake manifold vacuum for producing output ignition spark vacuum advance binary code representations of the predetermined number of crankshaft degrees ignition spark vacuum advance corresponding to the said intake manifold vacuum;

means responsive to one of said ignition spark vacuum advance binary code representations and said stored binary coded number for producing a second binary code representation of the quotient of the product of said ignition spark vacuum advance binary code representation multiplied by said stored binary coded number divided by the number of engine crankshaft degrees between successive said timing signals;

means for producing a third binary code representation of the sum of said first and second binary code representations;

means for producing a fourth binary code representation of the difference between said stored binary coded number and said third binary code representation;

a comparator circuit responsive to said fourth binary code representation and said running total output binary coded numbers for producing an ignition initiating signal when one of said running total output binary coded numbers is equal to said fourth binary code representation; and circuit means responsive to each of said ignition initiating signals for interrupting said engine ignition system ignition coil primary winding energizing circuit.

2. A digital electronic ignition spark timing system applicable to an associated internal combustion engine for producing ignition initiating signals for effecting the interruption of the engine ignition system ignition coil primary winding energizing circuit, comprising:

means for producing a series of electrical signal pulses of a substantially constant preselected frequency;

means for producing a timing signal for each cylinder of said engine at a selected engine crankshaft position in degrees relative to piston top dead center;

a counter circuit for counting said electrical signal pulses during each engine timing count period between successive said timing signals and producing a running total output binary coded number of said electrical signal pulses counted;

circuit means for accepting upon the initiation of each said engine timing count period the said counter circuit running total output binary coded total number of said electrical signal pulses counted during the previous said engine timing count period and for storing this binary coded number until the initiation of the next said engine timing count period;

means responsive to said stored binary coded number for producing an output first binary code representation of the fractional portion of said stored binary coded number that the predetermined number of crankshaft degrees ignition spark engine speed advance corresponding to the engine speed at which said stored binary coded number of said electrical signal pulses may be counted during one said engine timing count period is of the number of engine crankshaft degrees between successive said timing signals;

means responsive to the intake manifold vacuum of said engine for producing digital signal representations thereof;

means responsive to said digital signal representations of intake manifold vacuum for producing output ignition spark vacuum advance binary code representations of the predetermined number of crankshaft degrees ignition spark vacuum advance corresponding to the said intake manifold vacuum;

means responsive to one of said ignition spark vacuum advance binary code representations and said stored binary coded number for producing a second binary code representation of the quotient of the product of said ignition spark vacuum advance binary code representation multiplied by said stored binary coded number divided by the number of engine crankshaft degrees between successive said timing signals;

means for producing a third binary code representation of the sum of said first and second binary code representations;

means for producing a fourth binary code representation of the difference between said stored binary coded number and said third binary code representation;

a comparator circuit responsive to said fourth binary code representation and said counter circuit running total output binary coded numbers for producing an ignition initiating signal when one of said running total output binary coded numbers of said counter circuit is equal to said fourth binary code representation; and circuit means responsive to each of said ignition initiating signals for interrupting said engine ignition system ignition coil primary winding energizing circuit.

3. A digital electronic ignition spark timing system applicable to an associated internal combustion engine for producing ignition initiating signals for effecting the interruption of the engine ignition system ignition coil primary winding energizing circuit, comprising:

an oscillator circuit for producing a series of electrical signal pulses of a substantially constant preselected frequency;

means for producing a timing signal for each cylinder of said engine at a selected engine crankshaft position in degrees relative to piston top dead center;

a counter circuit for counting said electrical signal pulses during each engine timing count period between successive said timing signals and producing a running total output binary coded number of said electrical signal pulses counted;

a first register circuit for accepting upon the initiation of each said engine timing count period the said counter circuit running total output binary coded total number of said electrical signal pulses counted during the previous said engine timing count period and for storing this binary coded number until the initiation of the next said engine timing count period;

a first read only memory means preprogrammed to produce, in response to said stored binary coded number, an output first binary code representation of the fractional portion of said stored binary coded number that the predetermined number of crankshaft degrees ignition spark engine speed advance corresponding to the engine speed at which said stored binary coded number of said electrical signal pulses may be counted during one said engine timing count period is of the number of engine crankshaft degrees between successive said timing signals;

means including an engine vacuum sensor and an analog to digital converter circuit responsive to the intake manifold vacuum of said engine for producing digital signal representations thereof;

a second read only memory means preprogrammed to produce, in response to said digital signal representations of intake manifold vacuum, an output ignition spark vacuum advance binary code representation of the predetermined number of crankshaft degrees ignition spark vacuum advance corresponding to the said intake manifold vacuum;

a second register circuit for accepting upon the initiation of each said engine timing count period the said second read only memory means output ignition spark vacuum advance binary code representation and for storing this ignition spark vacuum advance binary code representation until the initiation of the next said engine timing count period;

a digital arithmetic logic unit responsive to said ignition spark vacuum advance binary code representation stored in said second register circuit and said binary coded number stored in said first register circuit means for producing a second binary code representation of the quotient of the product of said ignition spark vacuum advance binary code representation multiplied by said stored binary coded number divided by the number of engine crankshaft degrees between successive said timing signals;

a binary adder circuit for producing a third binary code representation of the sum of said first and second binary code representations;

a binary subtractor circuit for producing a fourth binary code representation of the difference between said binary coded number stored in said first register circuit means and said third binary code representation;

a comparator circuit responsive to said fourth binary code representation and said counter circuit running total output binary coded numbers for producing an ignition initiating signal when one of said running total output binary coded numbers of said counter circuit is equal to said fourth binary code representation; and circuit means responsive to each of said ignition initiating signals for interrupting said engine ignition system ignition coil primary winding energizing circuit.

4. A digital electronic ignition spark timing system applicable to an associated internal combustion engine for producing dwell and ignition initiating signals for effecting, respectively, the completion and interruption of the engine ignition system ignition coil primary winding energizing circuit, comprising:

means for producing a series of electrical signal pulses of a substantially constant preselected frequency;

means for producing a timing signal for each cylinder of said engine at a selected engine crankshaft position in degrees relative to piston top dead center;

a first counter circuit for counting said electrical signal pulses during each engine timing count period between successive said timing signals and producing a running total output binary coded number of said electrical signal pulses counted;

circuit means for accepting upon the initiation of each said engine timing count period the said first counter circuit running total output binary coded total number of said electrical signal pulses counted during the previous said engine timing count period and for storing this binary coded number until the initiation of the next said engine timing count period;

means responsive to said stored binary coded number for producing an output first binary code representation of the fractional portion of said stored binary coded number that the predetermined number of crankshaft degrees ignition spark engine speed advance corresponding to the engine speed at which said stored binary coded number of said electrical signal pulses may be counted during one said engine timing count period is of the number of engine crankshaft degrees between successive said timing signals;

means responsive to the intake manifold vacuum of said engine for producing digital signal representations thereof;

means responsive to said digital signal representations of intake manifold vacuum for producing output ignition spark vacuum advance binary code representations of the predetermined number of crankshaft degrees ignition spark vacuum advance corresponding to the said intake manifold vacuum;

means responsive to one of said ignition spark vacuum advance binary code representations and said stored output binary coded number of said first counter circuit for producing a second binary code representation of the quotient of the product of said ignition spark vacuum advance binary code representation multiplied by said stored binary coded number divided by the number of engine crankshaft degrees between successive said timing signals;

means for producing a third binary code representation of the sum of said first and second binary code representations;

means for producing a fourth binary code representation of the difference between said stored output binary coded number of said first counter circuit and said third binary code representation;

a first comparator circuit responsive to said fourth binary code representation and said first counter circuit running total output binary coded numbers for producing an ignition initiating signal when one of said running total output binary coded numbers of said first counter circuit is equal to said fourth binary code representation;

a second counter circuit for counting said electrical signal pulses during each ignition dwell count period between successive said ignition initiating signals and producing a running total output binary coded number of said electrical signal pulses counted;

circuit means for accepting upon the initiation of each said ignition dwell count period the said second counter circuit running total output binary coded total number of said electrical signal pulses counted during the previous said ignition dwell count period and for storing this binary coded number until the initiation of the next said ignition dwell count period;

means responsive to said stored output binary coded number of said second counter circuit for producing a fifth binary code representation of the difference between this said stored binary coded number and a predetermined constant number;

a second comparator circuit responsive to said fifth binary code representation and said second counter circuit running total output binary coded numbers for producing an output signal when one of said second counter circuit running total output binary coded numbers is equal to said fifth binary code representation;

means responsive to said output signal of said second comparator circuit for producing a first dwell initiating signal enabling signal;

means for producing a logic signal in response to a predetermined said second counter circuit running total output binary coded number;

means responsive to said logic signal for producing a second dwell initiating signal enabling signal;

means responsive to said first and second enabling signals for producing a dwell initiating signal; and circuit means responsive to each of said dwell initiating signals and each of said ignition initiating signals for completing and interrupting, respectively, said engine ignition system ignition coil primary winding energizing circuit.

5. A digital electronic ignition spark timing system applicable to an associated internal combustion engine for producing dwell and ignition initiating signals for effecting, respectively, the completion and interruption of the engine ignition system ignition coil primary winding energizing circuit, comprising:

means for producing a series of electrical signal pulses of a substantially constant preselected frequency;

means for producing a timing signal for each cylinder of said engine at a selected engine crankshaft position in degrees relative to piston top dead center;

a first counter circuit for counting said electrical signal pulses during each engine timing count period between successive said timing signals and producing a running total output binary coded number of said electrical signal pulses counted;

a first register circuit for accepting upon the initiation of each said engine timing count period the said first counter circuit running total output binary coded total number of said electrical pulses counted during the previous said engine timing count period and for storing this binary coded number until the initiation of the next said engine timing count period;

a first read only memory means preprogrammed to produce, in response to said stored binary coded number, an output first binary code representation of the fractional portion of said stored binary coded number that the predetermined number of crankshaft degrees ignition spark engine speed advance corresponding to the engine speed at which said stored binary coded number of said electrical signal pulses may be counted during one said engine timing count period is of the number of engine crankshaft degrees between successive said timing signals;

means including a vacuum sensor and an analog to digital converter circuit responsive to the intake manifold vacuum of said engine for producing digital signal representations thereof;

a second read only memory means preprogrammed to produce, in response to said digital signal representations of intake manifold vacuum, an output ignition spark vacuum advance binary code representation of the predetermined number of crankshaft degrees ignition spark vacuum advance corresponding to the said intake manifold vacuum;

a second register circuit for accepting upon the initiation of each said engine timing count period the said second read only memory means output ignition spark vacuum advance binary code representation and for storing this ignition spark vacuum advance binary code representation until the initiation of the next said engine timing count period;

a digital arithmetic logic unit responsive to said ignition spark vacuum advance binary code representation stored in said second register circuit and said binary coded number stored in said first register circuit for producing a second binary code representation of the quotient of the product of said ignition spark vacuum advance binary code representation multiplied by said stored binary coded number divided by the number of engine crankshaft degrees between successive said timing signals;

a binary adder circuit for producing a third binary code representation of the sum of said first and second binary code representations;

a first binary subtractor circuit for producing a fourth binary code representation of the difference between said binary coded number stored in said first register circuit means and said third binary code representation;

a first comparator circuit responsive to said fourth binary code representation and said first counter circuit running total output binary coded numbers for producing an ignition initiating signal when one of said running total output binary coded numbers of said first counter circuit is equal to said fourth binary code representation;

a second counter circuit for counting said electrical signal pulses during each ignition dwell count period between successive said ignition initiating signals and producing a running total output binary coded number of said electrical signal pulses counted;

a third register circuit for accepting upon the initiation of each said ignition dwell count period the said second counter circuit running total output binary coded total number of said electrical signal pulses counted during the previous said ignition dwell count period and for storing this binary coded number until the initiation of the next said ignition dwell count period;

a second binary subtractor circuit responsive to said binary coded number stored in said third register circuit for producing a fifth binary code representation of the difference between this said stored binary coded number and a predetermined constant number;

a second comparator circuit responsive to said fifth binary code representation and said second counter circuit running total output binary coded numbers for producing an output signal when one of said second counter circuit running total output binary coded numbers is equal to said fifth binary code representation;

a first bi-stable flip-flop circuit responsive to said output signal of said second comparator circuit for producing a first dwell initiating signal enabling signal;

a first AND gate for producing a logic signal in response to a predetermined said second counter circuit running total output binary coded number;

a second bi-stable flip-flop circuit responsive to said logic signal for producing a second dwell initiating signal enabling signal;

a second AND gate responsive to said first and second enabling signals for producing a dwell initiating signal; and circuit means responsive to each of said dwell initiating signals and each of said ignition initiating signals for completing and interrupting, respectively, said engine ignition system ignition coil primary winding energizing circuit.

6. A digital electronic ignition spark timing system applicable to an associated internal combustion engine for producing dwell and ignition initiating signals for effecting, respectively, the completion and interruption of the engine ignition system ignition coil primary winding energizing circuit, comprising:

means for producing a series of electrical signal pulses of a substantially constant preselected frequency;

means for producing timing signal pulses of a predetermined duration for each cylinder of said engine at a selected engine crankshaft position in degrees relative to piston top dead center;

a first counter circuit for counting said electrical signal pulses during each engine timing count period between the leading edges of successive said timing signals and producing a running total output binary coded number of said electrical signal pulses counted;

circuit means for accepting upon the initiation of each said engine timing count period the said first counter circuit running total output binary coded total number of said electrical signal pulses counted during the previous said engine timing count period and for storing this binary coded number until the initiation of the next said engine timing count period;

means responsive to said stored binary coded number for producing an output first binary code representation of the fractional portion of said stored binary coded number that the predetermined number of crankshaft degrees ignition spark engine speed advance corresponding to the engine speed at which said stored binary coded number of said electrical signal pulses may be counted during one said engine timing count period is of the number of engine crankshaft degrees between successive said timing signals;

means responsive to the intake manifold vacuum of said engine for producing digital signal representations thereof;

means responsive to said digital signal representations of intake manifold vacuum for producing output ignition spark vacuum advance binary code representations of the predetermined number of crankshaft degrees ignition spark vacuum advance corresponding to the said intake manifold vacuum;

means responsive to one of said ignition spark vacuum advance binary code representations and said stored output binary coded number of said first counter circuit for producing a second binary code representation of the quotient of the product of said ignition spark vacuum advance binary code representation multiplied by said stored binary coded number divided by the number of engine crankshaft degrees between successive said timing signals;

means for producing a third binary code representation of the sum of said first and second binary code representations;

means for producing a fourth binary code representation of the difference between said stored output binary coded number of said first counter circuit and said third binary code representation;

a first comparator circuit responsive to said fourth binary code representation and said first counter circuit running total output binary coded numbers for producing an ignition initiating signal when one of said running total output binary coded numbers of said first counter circuit is equal to said fourth binary code representation;

a second counter circuit for counting said electrical signal pulses during each ignition dwell count period between successive said ignition initiating signals and producing a running total output binary coded number of said electrical signal pulses counted;

circuit means for accepting upon the initiation of each said ignition dwell count period the said second counter circuit running total output binary coded total number of said electrical signal pulses counted during the previous said ignition dwell count period and for storing this binary coded number until the initiation of the next said ignition dwell count period;

means responsive to said stored output binary coded number of said second counter circuit for producing a fifth binary code representation of the difference between this said stored binary coded number and a predetermined constant number;

a second comparator circuit responsive to said fifth binary code representation and said second counter circuit running total output binary coded numbers for producing an output signal when one of said second counter circuit running total output binary coded numbers is equal to said fifth binary code representation;

means responsive to said output signal of said second comparator circuit for producing a first dwell initiating signal enabling signal;

means for producing a logic signal in response to a predetermined said second counter circuit running total output binary coded number;

means responsive to said logic signal for producing a second dwell initiating signal enabling signal;

means responsive to said first and second enabling signals for producing a dwell initiating signal;

circuit means responsive to each of said dwell initiating signals and each of said ignition initiating signals for completing and interrupting, respectively, said engine ignition system ignition coil primary winding energizing circuit;

means for producing an engine crank mode logic signal while said engine is being cranked; and circuit means responsive to said timing signal pulses and said engine crank mode logic signals for effecting the interruption and completion of said engine ignition system ignition coil primary winding energizing circuit in response to the leading and trailing edges, respectively, of each of said timing signal pulses while said engine is being cranked.

7. A digital electronic ignition spark timing system applicable to an associated internal combustion engine for producing dwell and ignition initiating signals for effecting, respectively, the completion and interruption of the engine ignition system ignition coil primary winding energizing circuit, comprising:

means for producing a series of electrical signal pulses of a substantially constant preselected frequency;

means for producing a timing signal pulse of a predetermined duration for each cylinder of said engine at a selected engine crankshaft position in degrees relative to piston top dead center;

a first counter circuit for counting said electrical signal pulses during each engine timing count period between the leading edges of successive said timing signals and producing a running total output binary coded number of said electrical signal pulses counted;

a first register circuit for accepting upon the initiation of each said engine timing count period the said first counter circuit output running total output binary coded total number of said electrical signal pulses counted during the previous said engine timing count period and for storing this binary coded number until the initiation of the next said engine timing count period;

a first read only memory means preprogrammed to produce, in response to said stored binary coded number, an output first binary code representation of the fractional portion of said stored binary coded number that the predetermined number of crankshaft degrees ignition spark engine speed advance corresponding to the engine speed at which said stored binary coded number of said electrical signal pulses may be counted during one said engine timing count period is of the number of engine crankshaft degrees between successive said timing signals;

means including a vacuum sensor and an analog to digital converter circuit responsive to the intake manifold vacuum of said engine for producing digital signal representations thereof;

a second read only memory means preprogrammed to produce, in response to said digital signal representations of intake manifold vacuum, an output ignition spark vacuum advance binary code representation of the predetermined number of crankshaft degrees ignition spark vacuum advance corresponding to the said intake manifold vacuum;

a second register circuit for accepting upon the initiation of each said engine timing count period the said second read only memory means output ignition spark vacuum advance binary code representation and for storing this ignition spark vacuum advance binary code representation until the initiation of the next said engine timing count period;

a digital arithmetic logic unit responsive to said ignition spark vacuum advance binary code representation stored in said second register circuit and said binary coded number stored in said first register circuit for producing a second binary code representation of the quotient of the product of said ignition spark vacuum advance binary code representation multiplied by said stored binary coded number divided by the number of engine crankshaft degrees between successive said timing signals;

a binary adder circuit for producing a third binary code representation of the sum of said first and second binary code representations;

a first binary subtractor circuit for producing a fourth binary code representation of the difference between said binary coded number stored in said first register circuit and said third binary code representation;

a first comparator circuit responsive to said fourth binary code representation and said first counter circuit running total output binary coded numbers for producing an ignition initiating signal when one of said running total output binary coded numbers of said first counter circuit is equal to said fourth binary code representation;

a second counter circuit for counting said electrical signal pulses during each ignition dwell count period between successive said ignition initiating signals and producing a running total output binary coded number of said electrical signal pulses counted;

a third register circuit for accepting upon the initiation of each said ignition dwell count period the said second counter circuit running total output binary coded total number of said electrical signal pulses counted during the previous said ignition dwell count period and for storing this binary coded number until the initiation of the next said ignition dwell count period;

a second binary subtractor circuit responsive to said binary coded number stored in said third register circuit for producing a fifth binary code representation of the difference between this said stored binary coded number and a predetermined constant number;

a second comparator circuit responsive to said fifth binary code representation and said second counter circuit running total output binary coded numbers for producing an output signal when one of said second counter circuit running total output binary coded numbers is equal to said fifth binary code representation;

a first bi-stable flip-flop circuit responsive to said output signal of said second comparator circuit for producing a first dwell initiating signal enabling signal;

a first AND gate for producing a logic signal in response to a predetermined said second counter circuit running total output binary coded number;

a second bi-stable flip-flop circuit responsive to said logic signal for producing a second dwell initiating signal enabling signal;

a second AND gate responsive to said first and second enabling signals for producing a dwell initiating signal;

circuit means responsive to each of said dwell initiating signals and each of said ignition initiating signals for completing and interrupting, respectively, said engine ignition system ignition coil primary winding energizing circuit;

means for producing an engine crank mode logic signal while said engine is being cranked; and circuit means responsive to said timing signal pulses and said engine crank mode logic signals for effecting the interruption and completion of said engine ignition system ignition coil primary winding energizing circuit in response to the leading and trailing edges, respectively, of each of said timing signal pulses while said engine is being cranked.

* * * * *